United States Patent [19]

Imsande

[11] 4,107,811

[45] Aug. 22, 1978

[54] TACKY FLOOR MAT WITH IMPROVED PEELING PROVISION

[75] Inventor: Grant A. Imsande, Arlington, Tex.

[73] Assignee: Arbrook, Inc., Arlington, Tex.

[21] Appl. No.: 788,942

[22] Filed: Apr. 19, 1977

[51] Int. Cl.[2] ..... A47L 23/22; B32B 7/06

[52] U.S. Cl. ..... 15/215; 15/104 A; 428/352

[58] Field of Search ..... 15/104 A, 215; 428/194, 428/352

[56] References Cited

U.S. PATENT DOCUMENTS

| | | | |
|---|---|---|---|
| 3,083,393 | 4/1963 | Nappi | 15/104 A X |
| 3,417,418 | 12/1968 | Riboud | 15/104 A |
| 3,665,543 | 5/1972 | Nappi | 15/215 |
| 3,974,311 | 8/1976 | Cherrin et al. | 428/352 X |

FOREIGN PATENT DOCUMENTS

| | | | |
|---|---|---|---|
| 2,015,118 | 10/1971 | Fed. Rep. of Germany | 428/352 |

*Primary Examiner*—Daniel Blum
*Attorney, Agent, or Firm*—Richard J. Rodrick

[57] ABSTRACT

An improved tacky floor mat for removing loose particles of dirt, dust and the like coming in contact therewith from shoes, wheels, etc. The floor mat includes a stack of adhered, peelable sheets with a layer of adhesive on the upper surface of each sheet. As the adhesive ability of each sheet is diminished it is peeled from the stack to expose the next fresh sheet. To improve the peeling of the sheet a thin coating of non-adhesive material is print deposited on the adhesive layer in a corner of the upper surface of each sheet. To inform the user which corner has been treated the thin coating is generally a different color than the sheets.

3 Claims, 5 Drawing Figures

TACKY FLOOR MAT WITH IMPROVED PEELING PROVISION

BACKGROUND OF THE INVENTION

This invention relates generally to tacky floor mats of the type wherein loose dirt, dust and soil is removed from shoes, wheels and the like which contact the surface of the mat. More particularly, this invention concerns an improved provision to facilitate peeling of adhesive sheets in a stack of the same which comprises the tacky mat.

Tacky floor mats are used in hospitals, industrial clean areas, and other similar applications as a means of removing loose particles of dirt, dust, and soil of the like especially from the soles of shoes and wheels of rolling equipment. Such a tacky mat lies on the floor generally at, before or just inside the entrance of the area which is intended to be protected from loose particles which may cause contamination. Before entering such a clean area, such as an operating room in a hospital, the person must cross the tacky mat whereupon the soles of his shoes contacting the adhesive surface of the mat will cause loose particles of dirt and dust to be removed from the shoes; similarly wheels of rolling equipment which may pick up loose dirt and dust also cross the tacky mat with the wheels being stripped of the undesirable loose particles as they pass over the adhesive mat. Most tacky mats of this type include a stack of adhesive sheets which are peelable from each other in descending order. As the adhesive ability of each sheet becomes diminished upon repeated use, the top most sheet is merely peeled off, thereby exposing a fresh adhesive sheet. This stacking arrangement of adhesive sheets is not only practical, but convenient, inexpensive and efficient. One aspect of this type of mat, however, has tended to diminish the effect of these desirable features, and that involves the provision to peel each sheet from the stack after it is used and worn.

In U.S. Pat. Nos. 3,083,393 and 3,665,543, for example, tab provisions are included on or between adjacent sheets generally at one or more corners to initiate and facilitate peeling. This tab is a non-tacky insert which, while assisting in the peeling of the sheet, admittedly adds thickness to the corner of the stack where it is located on each sheet. This cumulative effect of added thickness, especially with larger numbers of sheets in the stack, increases the problem of inadvertent tripping or stumbling on the mat, causes an excessive bump when rolling equipment passes across or causes the tab areas of one or more sheets to fold over onto the top sheet producing an unsightly appearance.

Another approach to make peeling the sheet from a stack easier is discussed in U.S. Pat. No. 3,501,797. In that patent a strand or string is interleaved between two adjacent adhered sheets in the stack and protrudes from one edge thereof. To peel each sheet, the strand is merely gripped and lifted thereby separating the upper sheet from the lower sheet. Use of strands between adjacent sheets also increases the thickness of the stack in cumulative fashion especially in stacks with large numbers of sheets. Additionally, inserting a strand between two sheets requires an additional fabrication operation thereby causing production inefficiencies.

Instead of non-tacky material or tabs or strands between adjacent adhered sheets, the edges of each sheet can be left free of adhesive and beveled in the stack to facilitate peeling. Such a configuration is revealed in U.S. Pat. No. 3,785,102. In leaving the edge of each sheet, for example in a corner thereof, free of adhesive, alignment and deposition of the adhesive layer on each sheet must be carefully programmed, often with sophisticated expensive techniques and equipment. Furthermore, beveling the edges of the stack of sheets is an undesirable additional fabrication operation which further detracts from the practicability and efficiency of the tacky floor mat concept.

SUMMARY OF THE INVENTION

The improved tacky floor mat of the present invention overcomes the deficiencies, especially associated with the undesirable thickened areas on the known floor mats, while providing a means to facilitate peeling of the adhesive sheets of the stack. In addition to eliminating the disadvantageous thickened or heightened corners of the mat, the improvement of the present invention allows for rapid and efficient fabrication, thereby keeping production expense to a minimum, while also allowing for more individual sheets to be maintained in a single stack since the corner heightening problem is eliminated or reduced.

Moreover, the improved peeling provision of the present invention is usable on many, if not all, of the presently known and available tacky floor mats to achieve the desirable features inherent in this invention.

In accordance with the principles of this invention, a tacky floor mat for removing loose particles of dirt, dust and the like coming in pressure contact therewith has been improved. This tacky floor mat is of the type having a stack containing a plurality of superimposed adjacently adhered sheets therein. Each sheet is substantially identical in size and has a pressure-sensitive adhesive layer on substantially the entire upper surface thereof. The lower surface of each sheet is less adhesively treated than the upper surface or substantially non-adhesively treated so that adjacently adhered sheets are peelable from each other in descending order. To initiate the peeling of each sheet the improvement comprises a thin coating of non-adhesive material print deposited on top of the adhesive layer in at least one corner of the upper surface of each sheet. This thin coating renders the upper corner so treated non-adhesive. So that the section whereupon the peeling is to originate is readily indicated to a user thereof, the non-adhesive coating is a different color than the color of each of the sheets or the adhesive layer thereon. The effect of this improvement is to facilitate the peeling of each sheet from the stack, and also to keep the stack as flat as possible especially in the corners which have been treated where the peeling is to start. The improvement of this invention achieves these desirable goals.

In the preferred embodiment of the present invention the thin coating of non-adhesive material adds no detectable thickness to the mat, but could be applied to the mat in thicknesses approaching 0.003 in. (0.0076 cm.). The coating comprises an ink for color, an adhesive coating ingredient and a silicone material for adhesive release properties.

BRIEF DESCRIPTION OF THE DRAWINGS

These and other advantages, features and aspects of the invention will become apparent upon reading the following detailed description and upon reference to the accompanying drawings, in which.

While the invention will be described in connection with a preferred embodiment, it is understood that it is not intended to limit the invention to that embodiment. On the contrary, it is intended to cover all alternatives, modifications, and equivalents as may be included within the scope and spirit of the described invention.

DETAILED DESCRIPTION OF THE DRAWINGS

Figure 1:
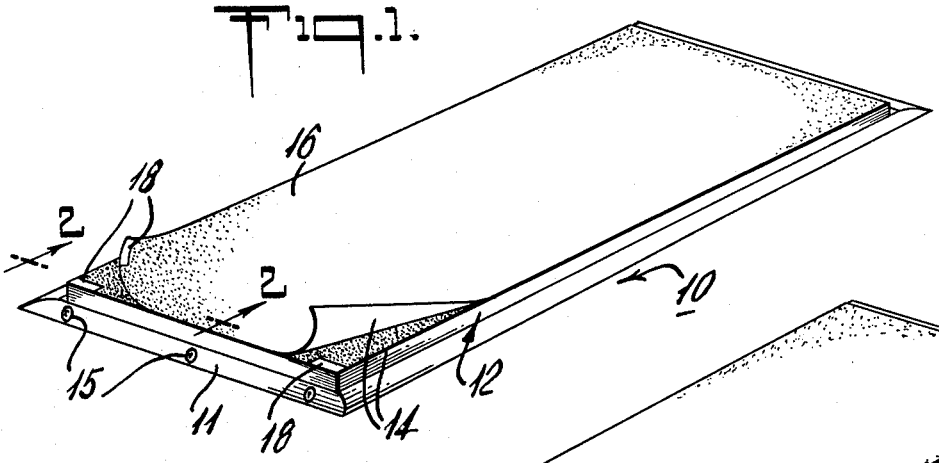
FIG. 1 is a perspective view showing the improved peeling provision on a typical tacky floor mat.
Figure 2:
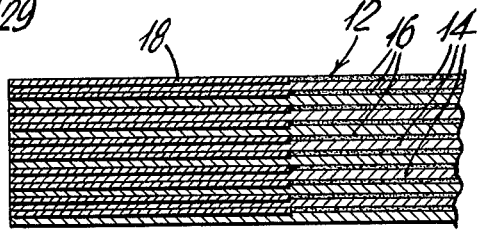
FIG. 2 is a sectional view taken along lines 2—2 of FIG. 1 and only depicting the stack of sheets.

Referring to the drawings wherein preferred and other embodiments of the present invention are illustrated, there is shown, particularly in FIGS. 1 and 2, a tacky floor mat 10 which incorporates the improved peeling provision herein. This tacky floor mat 10 is the type which has a frame 11 for supporting a stack 12 of sheets 14 thereon. Frame 11 may be permanently affixed to the floor area using appropriate hardware and fastening openings 15, while the borders of the frame generally are inclined upwards towards the stack 12 so that wheels rolling over the mat will encounter reduced or limited shock. As can be seen the stack 12 contains a plurality of superimposed sheets 14 which are adjacently adhered together in the stack.

Each sheet 14 of the stack is substantially identical in size with the other sheets, and is formed of a flexible support material, such as described in U.S. Pat. Nos. 3,083,393 and 3,665,543. On substantially the entire upper surface of each sheet 14 is a layer of pressure-sensitive adhesive 16, generally of moderate tackiness and of the type which is commonly used in masking tape. The lower surface of each sheet 14 is substantially non-adhesively treated, i.e., each lower surface has no adhesive material thereon or may be treated with an adhesive layer with a degree of tackiness less than the adhesive on the upper surface of each sheet. This type of treatment, of course, will allow adjacently adhered pairs of superimposed sheets to be peeled from each other. Preferably, the lower surface of each sheet includes a film thereacross which is adhesive releasable so that when each sheet is peeled from the other the adhesive layer remains attached to the upper surface of the sheet with undiminished tackiness. Accordingly, the stack 12 of sheets is arranged so that the adhesive layer 16 faces upwards to accommodate the passing shoes of persons walking across, wheels of rolling equipment and the like. When the adhesive layer 16 of each sheet becomes substantially diminished it is intended to peel the top most sheet away from the stack to expose the fresh adhesive sheet underneath. This procedure continues in descending order until the stack is depleted.

To initiate the peeling of each sheet 14 from its adjacently attached sheet, one or more corners of each sheet incorporates the peeling provision of the present invention. On top of the adhesive layer 16 in a corner of the upper surface of sheet 14 a thin coating of non-adhesive material 18 is print deposited. By printing the non-adhesive material 18 atop the adhesive layer, it is possible to keep the deposited coating so thin that it is virtually impregnated in the adhesive layer. While some thickness is added to the corner where non-adhesive coating occurs, it is virtually not detectable, and preferably not greater than 0.001 inches (0.0025 cm.). This thin coating compares most favorably with the standard tape tab which is used with typical tacky floor mats and which generally have a thickness of about 0.003 inches (0.0076 cm.). Accordingly, the effect of the thin non-adhesive coating 18 is illustrated in FIG. 2 where it is seen that the stack has no or minimal cumulative thickness or heightening in the treated corners. This, advantageously, substantially reduces the possibility of tripping, snagging of wheels and inadvertent or premature peeling of each sheet in the stack.

In addition to the desirable minimal thickness features of the non-adhesive coating 18, it is also feasible and practicable to color the coating a different color than each of the sheets 14, or than the adhesive layer 16, which primarily causes the coloring effect of the sheet. If only one corner of the sheet has been non-adhesively coated, the user of the mat has a ready indication that peeling of the sheet from the stack is to start in the corner with the colored coating. Thus, that corner is readily lifted from the sheet underneath and acts as a grippable tab to originate peeling of the entire sheet. Of course, if more than one corner has been non-adhesively coated the peeling may originate in any such corner.

Figure 3:
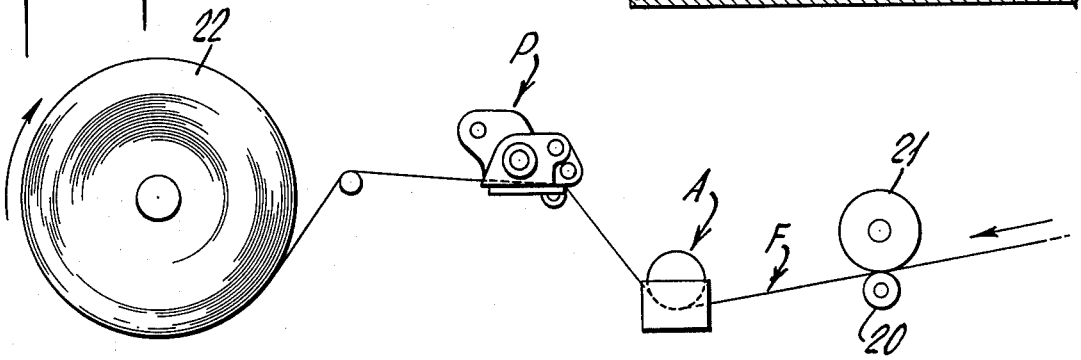
FIG. 3 is a schematic illustrating an embodiment for print depositing the improved peeling provision.

Besides offering minimal additional thickness to the coated corner and facilitation of sheet peeling, coating 18 is economically and conveniently applied to its respective location on each sheet. For instance, FIG. 3 illustrates a typical means by which the non-adhesive coating 18 is printed onto the surface of the sheets. Support material or film F is supplied in a continuous running length and is guided by rolls 20 and 21 to station A whereupon adhesive material is deposited on substantially the entire upper surface of the film. From station A the film is directed to a printer P which includes a well therein for the non-adhesive coating to be deposited on the film. Printer P is programmed to deposit a thin coating of the non-adhesive material on top of the adhesive layer at periodic intervals; these intervals are determined by the size of the sheets which are subsequently cut and formed. From the printing station the treated film passes to a rewind roll 22 for storage until the individual sheets are cut to size in a subsequent operation. While this operation illustrated in FIG. 3 is indicative of the typical approach to deposit the non-adhesive coating on the sheet material, other print depositing techniques may be used to achieve the results and features of the present invention.

Many non-adhesive coating materials or mixtures are usable within the purview of this invention, with the choice of non-adhesive coating available from well known materials exhibiting these properties and as can be readily ascertained by those skilled in this art. The example hereinafter provided illustrates a typical formulation to provide the non-adhesive coating of this invention.

Figure 4:
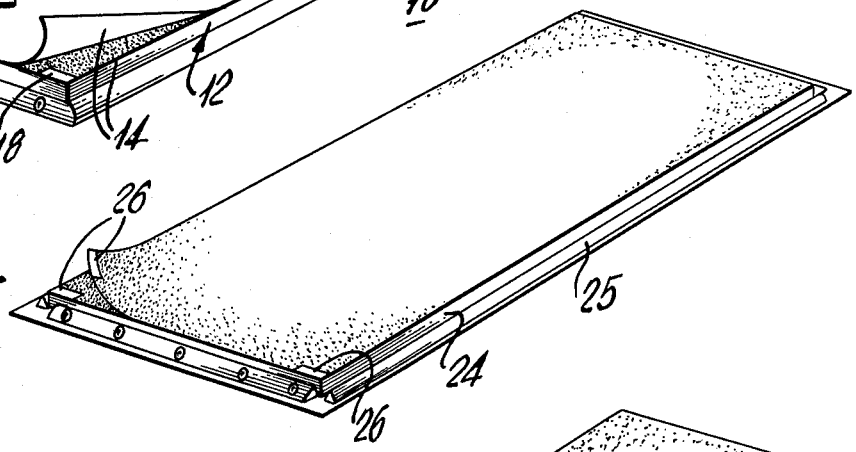
FIGS. 4 and 5 depict alternate tacky floor mats with which the improved peeling provision may be used.
Figure 5:
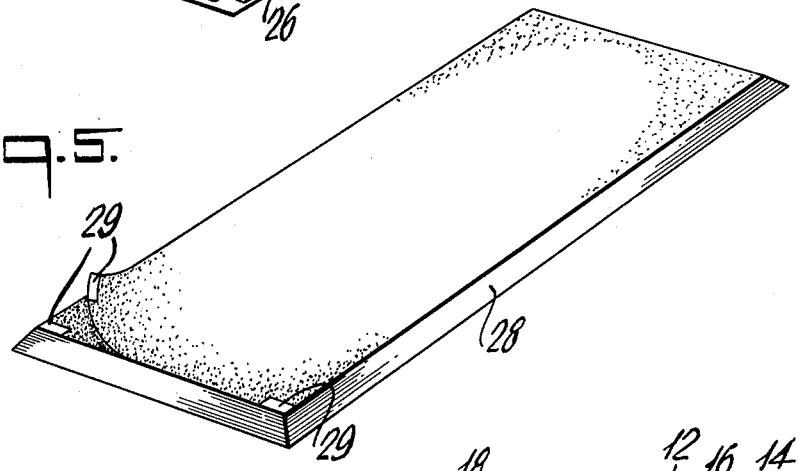

A variety of tacky floor mat arrangements can conceivably use the peeling improvement of the present invention. Two of the various other floor mat configurations embodying the improvement of the present invention are illustrated in FIGS. 4 and 5. In FIG. 4 the stack 24 of sheets is mounted on or secured to a support 25 which in itself is disposable after the last adhesive sheet has been depleted from the stack 24. As seen in FIG. 4 each sheet of the stack includes a coating of non-adhesive material 26, in this instance, in two of the corners thereof. Turning to FIG. 5, the stack 28 of sheets may be employed for use without a frame or support such as described in U.S. Pat. No. 3,785,102.

Non-adhesive coatings 29 are conveniently deposited on one or more corners of this stack arrangement also.

Typical tacky floor mats of the type herein discussed are generally rectangular in shape, but come in any size and shape which is convenient and practicable to fabricate and use. The floor mats depicted, for example, in FIGS. 1 and 4 are approximately 48 inches long by 20 inches wide (122 by 50 cm.). It is expected that with the improved non-adhesive coating for peeling purposes embodied in such a floor mat, it would be feasible to stack by superimposition approximately 30 or even a greater number of sheets in one stack. This provides longer use of the individual stacks without replacement, besides the economical advantages.

The invention will be further illustrated by the following example. It should be understood, however, that although this example may describe in particular detail some of the more specific features of this invention, it is primarily for purposes of illustration, and the invention in its broader aspects is not to be construed as limited thereto.

EXAMPLE

A tacky floor mat is produced in accordance with the configuration depicted in FIG. 4 hereof. A disposable support is formed of 0.025 inch (0.0635 cm.) styrene having dimensions of 48 by 20 inches (122 by 50 cm.). A stack of 30 superimposed sheets substantially identical in size and approximately one inch shorter on each edge than the support is secured to the support. Each sheet has a layer of pressure-sensitive adhesive material on the upper surface thereof of moderate tackiness; there is no adhesive material on the lower surface of each sheet. To provide and facilitate ready peeling of each sheet from its adhered adjacent sheet, two corners of the upper surface of each sheet have a blue colored non-adhesive coating print deposited thereon by a technique similar to that illustrated in FIG. 3 hereof. In this embodiment the blue coating is quite distinguishable from the gray tone of adhesive on the upper surface of each sheet. The non-adhesive coating allows the treated corner to be easily lifted so that peeling of the entire sheet can be originated. Each non-adhesive coating produces no detectable addition of thickness in the area on which it is deposited on the sheet. To produce the non-adhesive coating, the following formulation is used:

| Parts | Constituent Ingredient |
|---|---|
| 7.9 | basic blue ink |
| 0.1 | L.E.-46 Methyl Silicone |
| 2 | 20% JONCRYL solution |

Comprising the basic blue ink are the following ingredients:

2 grams blue dye;
98 grams anhydrous methanol.

The 20% JONCRYL solution includes the following:
20 grams JONCRYL 67 (an acrylic acid polymer purchased from S. C. Johnson & Son, Inc.) and sold under the trademark JONCRYL;
80 grams methanol The L.E. −46 Methyl Silicone is the designation for a 35% solution of the same as purchased from Union Carbide Company.

Such a three part combination has been found to provide a sufficient non-adhesive colored coating in that the JONCRYL provides a coating over the adhesive so that the final product is not sticky, whereas the silicone ingredient provides the non-adhesive effect.

Thus, it is apparent that there has been provided in accordance with the invention a tacky floor mat with an improved peeling provision that fully satisfies the aims, advantages, aspects as set forth above. While the invention has been described in conjunction with specific embodiments thereof, it is evident that many alternatives, modifications and variations will be apparent to those skilled in the art in view of the foregoing description. Accordingly, the plenary invention is intended to embrace all such alternatives, modifications and variations as fall within the broadest scope and spirit of the described invention.

What is claimed is:

1. In a tacky floor mat for removing loose particles of dirt, dust and the like coming in pressure contact therewith of the type having a stack containing a plurality of superimposed adjacently adhered sheets, each sheet being substantially identical in size and having a pressure-sensitive adhesive layer on substantially the entire upper surface thereof, with the lower surface of each sheet being less adhesively treated than said upper surface of each sheet so that said adjacently adhered sheets are peelable from each other in descending order, wherein the improvement to initiate the peeling of each sheet comprises: a thin coating of non-adhesive material being print deposited on top of said adhesive layer in at least one corner of said upper surface of each sheet to render said upper corner non-adhesive to facilitate peeling of said sheet, said non-adhesive coating being a different color than the color of each of said sheets to readily indicate the section whereupon said peeling is to originate, said coating comprising an ink for color, an adhesive coating ingredient and silicone for adhesive release properties.

2. An improved tacky floor mat as defined in claim 1 wherein said lower surface of each sheet is substantially non-adhesively treated.

3. An improved tacky floor mat as defined in claim 1 wherein said coating has a thickness range greater than zero and less than or equal to 0.003 inches.

* * * * *